US012514308B2

(12) United States Patent
Mittig

(10) Patent No.: US 12,514,308 B2
(45) Date of Patent: Jan. 6, 2026

(54) DISPOSABLE PANTS-PROTECTING PAINTER'S CHAPS

(71) Applicant: David W. Mittig, Petoskey, MI (US)

(72) Inventor: David W. Mittig, Petoskey, MI (US)

( * ) Notice: Subject to any disclaimer, the term of this patent is extended or adjusted under 35 U.S.C. 154(b) by 15 days.

(21) Appl. No.: 18/080,126

(22) Filed: Dec. 13, 2022

(65) Prior Publication Data

US 2023/0180861 A1 Jun. 15, 2023

Related U.S. Application Data

(60) Provisional application No. 63/289,498, filed on Dec. 14, 2021.

(51) Int. Cl.
*A41D 13/04* (2006.01)

(52) U.S. Cl.
CPC ..... *A41D 13/04* (2013.01)

(58) Field of Classification Search
CPC ..... A41D 13/0543; A41D 13/04; A41D 13/0556; A41D 27/12; A41D 2400/52; A47G 11/001
See application file for complete search history.

(56) References Cited

U.S. PATENT DOCUMENTS 5,484,645 A * 1/1996 Lickfield ..... D04H 3/14 428/374
6,338,164 B1 * 1/2002 Howard ..... A41D 13/06 2/242
8,312,564 B2 * 11/2012 Beshlian ..... A41D 13/1209 2/46
9,265,291 B2 * 2/2016 Weber ..... A41D 13/0543
11,864,602 B2 * 1/2024 Dorsey ..... A41D 13/04
2006/0010576 A1 * 1/2006 Tse ..... A41D 27/12 2/244
2011/0179558 A1 * 7/2011 Lyons ..... B32B 5/22 2/457
2013/0091614 A1 * 4/2013 Teets ..... A41D 13/04 2/51
2021/0401098 A1 * 12/2021 Ishikawa ..... A41D 13/00

OTHER PUBLICATIONS www.specoat.com, "Isolation Gown Fabric," Technical Data Sheet.

* cited by examiner

*Primary Examiner* — Katherine M Moran
(74) *Attorney, Agent, or Firm* — Mitchell Intellectual Property Law, PLLC

(57) ABSTRACT

Disposable chaps with wiping faces on the thighs. A single mid-thigh strap closer to a contoured crotch cutout than to a lower hem is used for securing the thigh portions of the chaps around the upper legs, and a novel non-absorbent, shape-holding medical barrier material is used to both improve the removal of paint, caulk, etc. from the hands, and also to help conform the unsecured lower end portions and free hems of the thigh portions to the wearer's pants while working.

11 Claims, 4 Drawing Sheets

DISPOSABLE PANTS-PROTECTING PAINTER'S CHAPS

RELATED APPLICATIONS/PRIORITY BENEFIT CLAIM

The present application claims priority to U.S. Provisional patent application Ser. No. 63/289,498 filed Dec. 14, 2021, the entirety of which provisional application is incorporated herein by reference.

FIELD

The subject matter of the present application is in the field of chaps for protecting pants from getting dirty.

BACKGROUND

A constant problem for painters, mechanics, gardeners, and anyone else who gets their hands dirty in the course of their work is wiping their hands on their pants and ruining the pants, at least for anything other than future work use.

The present inventor previously invented and sold disposable chaps that addressed this problem, under the trademark "Original Handy Chaps" ™. The disposable chaps tied around the waist like an apron, and included tie-on thigh portions that wrapped partway around the thighs above the knee in front. The thigh portions were fastened in place over the front of the upper pant legs with a spaced pair of straps on each thigh portion, with upper and lower straps extending from the outer side edges of the thigh portions around the rear of the thighs to corresponding upper and hem-securing fastening points on the inner side edges of the thigh portions.

The thigh portions of the chaps included three "face" layers of polypropylene-backed material with an absorbent face on which a user could wipe his or her hands. The tear-off face layers were sewn together along their upper and side edges, and un-sewn along their lower edges, so that each layer could be torn off individually when it became too dirty to continue wiping hands on it. In this manner a fresh, clean wiping surface was provided until all of the layers were used up.

Some disadvantages of these previous disposable chaps included difficulty in adjusting and fastening the thigh straps around the back of the legs; difficulty in tearing off the disposable face layers on the thighs while wearing them, especially without getting the pants dirty near the lower edges; and uneven tearing of the face layers, potentially leaving dirty, uneven portions hanging along the edges of the chaps that could be inadvertently brushed against the pants or other clothing. For these reasons I have invented an improved pair of disposable chaps that are significantly easier to adjust and use, and that provide better protection for the pants.

BRIEF SUMMARY

The present invention is a pair of disposable hands-wiping chaps for keeping the upper legs of a worker's pants clean while in use.

In general, the chaps comprise an upper waist portion configured to extend circumferentially at least part way from front to back around a worker's waist; and two spaced hands-wiping thigh portions attached to and depending from the waist portion and configured to wrap partially around the thighs from front to back to cover front and preferably side portions of the thighs. The waist portion includes fastening means (e.g., a strap, belt, cord, or ties) to fasten around the waist. Each thigh-covering portion also includes a fastening strap (or equivalent wraparound flexible connector such as a cord) at a single mid-thigh location adjacent the lower end of a contoured crotch cutout to extend around the back of the leg between the sides of the thigh portion, to secure the thigh portion snugly across the front and preferably partway around the sides of the thigh at the mid-thigh location adjacent the crotch. The mid-thigh location is spaced above the lower edge or hem of the thigh portion, located closer to the crotch cutout area of the chaps than to the hem.

In a further form, each thigh-fastening strap is attached at the mid-thigh location along an inside edge of the thigh portion, and is removably fastened at a corresponding mid-thigh location to a single fastening point along the outside edge of the thigh portion.

In a further form, the preferred material used for at least the outer face of the thigh portions of the chaps is a non-woven, essentially non-absorbent composite medical fabric material of known type, used, for example, in medical isolation gowns. The fabric material is fluid-resistant, but is believed to be essentially non-absorbent due to the undesirability of absorbing and trapping bodily fluids on disposable medical clothing. Unexpectedly, however, the properties of this material seem to attract or draw and remove painter's fluids such as paint and caulk from the hands, better than an absorbent material would, and to hold them on the fabric. Further, the preferred material in a single layer sheet configuration is extremely lightweight and breathable, yet seems to hold its shape with a "memory" effect relative to the wearer's thighs that helps conform the thigh portions of the chaps to the wearer's pants while working, including the unsecured lower portions of the chaps below the mid-thigh straps.

When the preferred material is combined with the single mid-thigh fastening strap on each thigh portion adjacent the contoured crotch, and with the inner-to-outer fastening direction of the fastening straps, the thigh portions of the chaps are easily secured to the user's legs with a single strap, even for users with mobility or size issues, with improved circulation and breathability for the lower legs, and with a good degree of protection for the pants even over the unsecured lower part of the thigh portions between the mid-thigh strap and the free hem.

These and other features and advantages of the invention will become apparent from the detailed description below, in light of the accompanying drawings.

DETAILED DESCRIPTION

Figure 1:
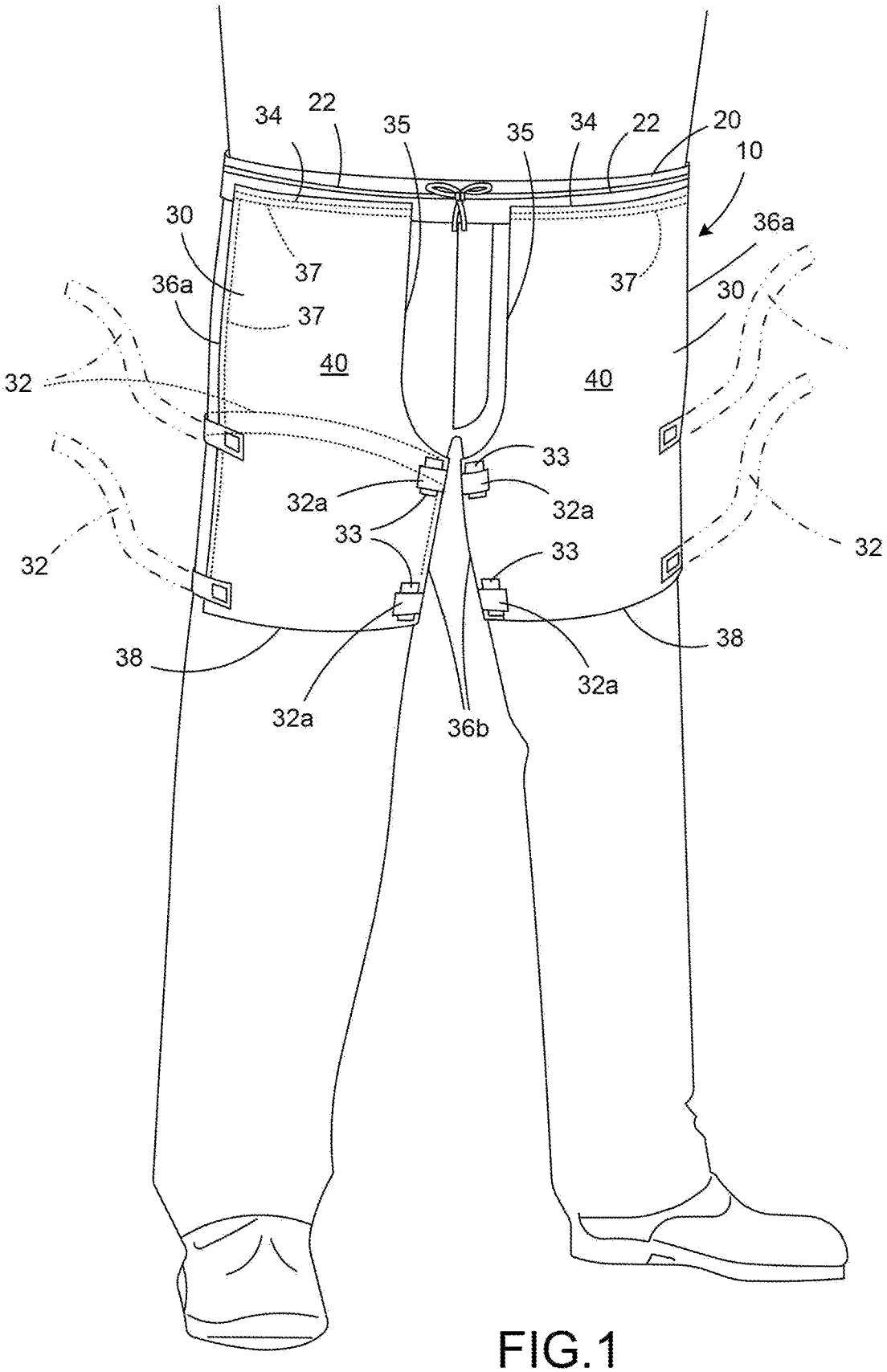
FIG.1 PRIOR ART
FIG. 1 is a perspective view of a prior art pair of disposable chaps, showing a face layer being tom off.

Prior Art—FIG. 1

Referring first to FIG. 1, a prior art pair of disposable chaps 10 is shown being worn by a worker. Chaps 10 have a partial-circumference waist 20 fastened with ties or straps 22 attached to and wrapped around the open back of the waist, like an apron, and if long enough brought around to the front for tying, as illustrated. Thigh portions 30 are attached to and depend from the waist 20, with top edges 34, outer side edges 36*a*, inner side edges 36*b*, and bottom hem edges 38; contoured crotch cutout edges 35 at the upper, inner portions of the inner side edges to provide a comfortable spacing at the crotch; and absorbent wiping face front panels or "faces" 40 comprising the majority of the area of the thigh portions. Thigh portions 30 also include spaced upper and lower pairs of straps 32, 33 attached to the outside edges 36*a* by sewing, and removably fastenable to the inside edges 36*b* with hook-and-loop fastener material on the inside faces of their ends 32*a* that mates with mating fastener material 33 sewn to the inside edges 36*b* of the thigh portions. The lower straps 33 are located adjacent the bottom hem edges 38 to secure the lower hems securely to the pants.

Continuing the description of the prior art FIG. 1 product, the waist portion 20 of chaps 10 is a band of light, comfortable cloth material such as cotton. Face panel portions 40 of each thigh portion 30 comprise multiple overlying panels or sheets each having absorbent outer or front surfaces of material such as 60/40 cotton/rayon non-woven textured fabric. The inner or rear surfaces of the sheets comprise a non-absorbent or waterproof barrier material such as smooth polypropylene or other plastic. Accordingly, each sheet has an outer absorbent wiping layer, and an inner non-absorbent (waterproof) layer to prevent oil, paint, dirt, etc. from going through the sheet(s) and staining the sheet (and ultimately the clothing) underneath. The innermost sheet's waterproof layer may be further be covered with a sweat-reducing backing such as cotton on the side facing the wearer, if desired.

The top and side edges 34, 36 of the layered sheets of each face panel 40 of the thigh portions 30 are lightly attached together by sewing at seams 37. The bottom edges 38 of the sheets are un-attached to one another, so that a hand can be inserted between them at their bottom edges to exert an upward tearing force. Accordingly, the top two sheets can be selectively torn off as they get too dirty to effectively wipe or absorb any more paint, oil, dirt, etc. The tearing occurs at the sewn seams 37, around the side and top edges of the sheets. The lower hem straps 33 further anchor the lower hem edges 38 of the thigh portions to the legs when the face sheets are tom off as they become dirty.

Figure 2:
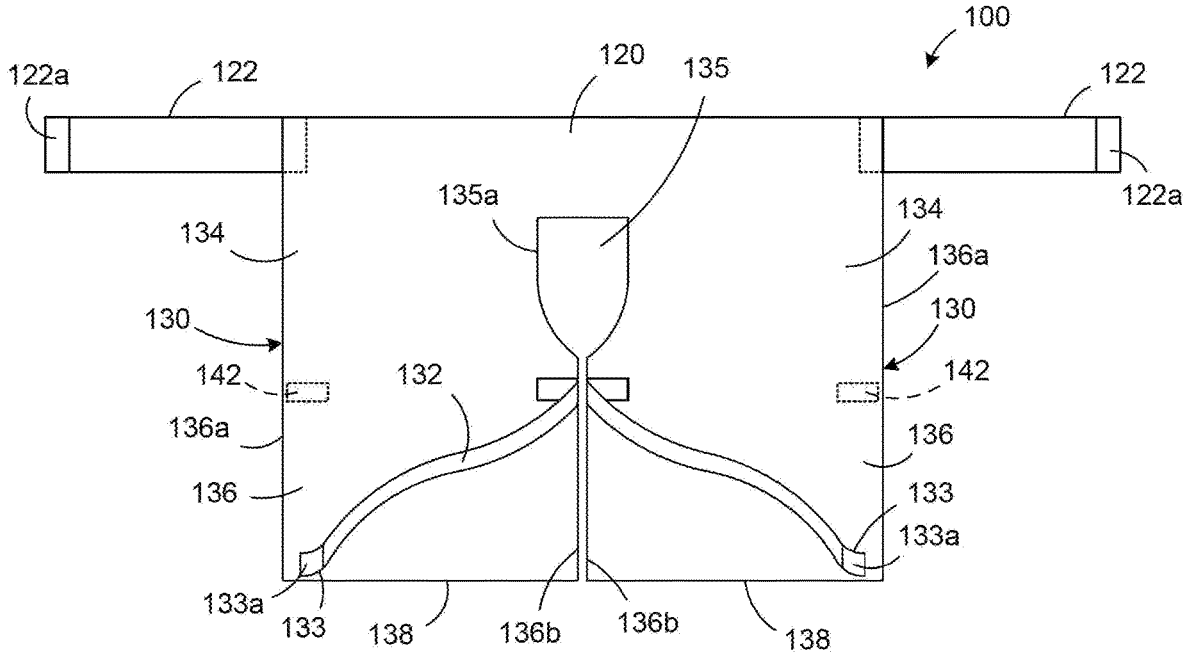
FIG. 2 is a rear/inner side flat or "plan" view of an example pair of disposable chaps according to a preferred embodiment.
Figure 3:
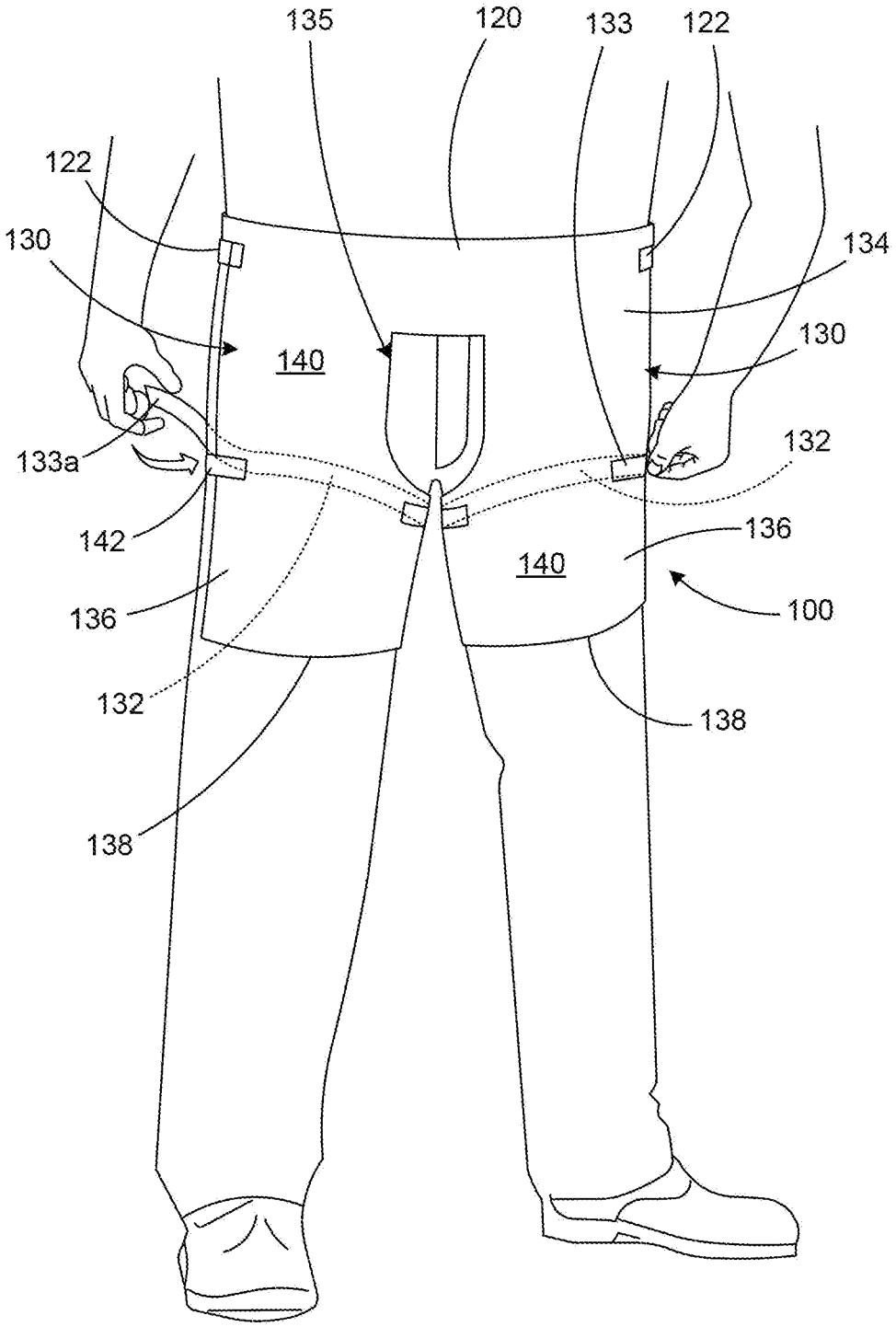
FIG. 3 is a perspective view of the chaps of FIG. 2 being put on by a worker.
Figure 4:
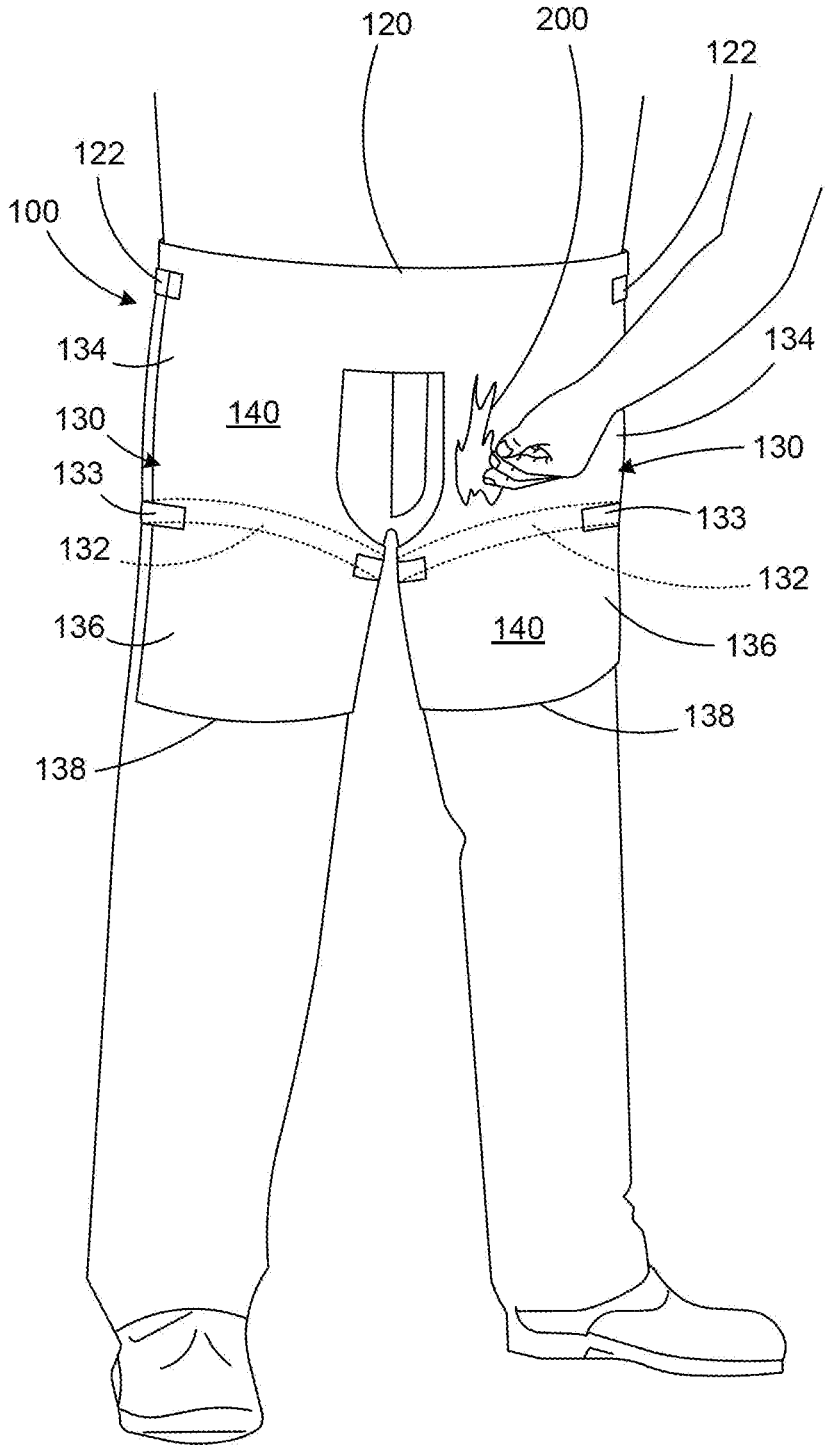
FIG. 4 is a perspective view of the chaps of FIG. 2 being worn by a worker.

Preferred Embodiments of FIGS. 2-4

Referring next to FIG. 2, an example pair of improved disposable chaps 100 according to an embodiment of the present invention is shown laid generally flat on a surface, with the inner side of the chaps visible. Chaps 100 have an upper waist portion 120, sized to extend at least partially around the waist from front to back and to be secured with one or more straps, ties, etc. 122. In the illustrated example, the waist securing means 122 is a strap divided into two portions, one portion secured to each outer end of the waist portion 120. In a preferred form, the waist strap portions 122 each comprise an elastic material with mating hook-and-loop type connector patches 122*a* at their respective ends and/or extended over their inner and outer faces to adjustably secure the strap portions 122 together around or behind the waist at a comfortable position as desired.

Chaps 100 have sheet-like thigh portions 130 attached to and depending from the waist portion 120, similar in shape and size to the thigh portions 30 in prior chaps 10 in FIG. 1. The thigh portions have upper portions 134, outer and inner side edges 136*a* and 1366, lower portions 136, bottom hem edges 138, and a contoured crotch cutout 135 corresponding generally to the upper portions 134 and terminating at the upper ends of the inner side edges 136*b*.

In the illustrated example of FIG. 2, the waist and thigh portions of the chaps 100 are made (e.g., cut) from a single continuous sheet of relatively thin fabric-like material capable of preventing paint, caulk, mud, oil, etc. from penetrating through the chaps to underlying pants. It is also possible to use different materials for the waist and thigh portions, and to join the waist portion to the thigh portions by sewing, sonic or heat welding, adhesive, or in some other known manner. In the illustrated example, any separately formed pieces of the chaps are preferably joined by sonic welding.

Further in the illustrated example, the material used for at least the hands-wiping outer faces of the thigh portions 130 (and for the waist portion 120 if integral with the thigh portions) is a non-woven composite fabric material with a microporous coating of a type normally used in medical barrier clothing, such as the "Isolation Gown Fabric" from Specialty Coating & Laminating, LLC (www.specoat.com). In the current preferred form, the material is a single-layer of this fabric material with a 72 gsm weight and a thickness in the 11-mil range, although these specifications may vary within the normal weight ranges for this type of fabric material. This fabric material's fluid-resistant but essentially non-absorbent properties, along with its mechanical stretch/flex/tensile properties, results in a superior material for use as disposable painter's chaps with minimal need for strapping or for otherwise securing and positioning the thigh portions of the chaps relative to the wearer's legs. This results in increased case of putting the chaps on, increased breathability and comfort, and a surprising paint-and-caulk handling response to splatter and hands-wiping.

Thigh portions 130 comprise outer wiping faces 140 (best seen in FIGS. 3 and 4) comprising the outer surface of a panel or sheet of the above-described isolation gown material. The wiping faces 140 are preferably coextensive with the thigh portions 130, i.e., the thigh portions 130 are made of or covered entirely by the wiping face fabric material. It should be understood that while a single sheet or layer of the preferred material is used for the illustrated chaps, layered configurations of one or more sheets are possible (although believed to be unnecessary).

The length of the thigh portions 130 may vary, but the lower unsecured hems 138 should terminate above the knee of the person wearing chaps 100.

Referring now to FIGS. 2, 3 and 4, fastening means 132 for securing the thigh portions 130 of chaps 100 around the wearer's legs are illustrated as a single strap secured to an upper end of each of the inner side edges 136*b* of the lower thigh portions 136, at a "mid-thigh" location at or closely adjacent the lower ends of the respective crotch cutout side edges 135*a*. Although elastic straps 132 are illustrated, similar in material to that used for waist strap 122, equivalent fastening means such as elastic or length-adjustable cords could be used. Each strap 132 is attached more or less permanently, as by sewing or sonic welding, at 131 to the inner side edge 136*b* of the respective thigh portion 130. The outer, free end 133 of each strap 132 is provided with a fastener or connector 133*a*, in the illustrated example a hook-and-loop connector patch, configured to mate with a corresponding fastening point 142 located on the outer face of the respective outer side edge 136*a*, e.g., a mating patch of hook-and-loop material.

While hook-and-loop type fastener material is preferred for the mating mid-thigh strap fasteners at 133*a*, 142, it should be understood that other lightweight fasteners could be used, for example but not limited to snaps, hooks, or magnetic material.

Description of Operation

In operation, chaps 100 are first tied around the wearer's waist at waist portion 120 using strap(s) 122, with the thigh portions 130 draped over the front of the wearer's upper legs and the outer wiping faces 140 facing outwardly. Next, thigh portions 130 are tied around the wearer's thighs at the mid-thigh location by wrapping each strap 132 around the back of the respective leg from the inside edge 136*b* of the respective thigh portion and fastening the connector end 133*a* directly to the associated fastener portion 142 at a corresponding mid-thigh height on the outer side edge 136*a* of the respective thigh portion 130. The length of each strap 132 and its desired tightness around the thigh can be adjusted, for example, by providing an elongated region of hook-and-loop material, or an elongated region or row of other connector material, extending inwardly from the end portions 133 of the straps 132, which, coupled with the preferred elastic nature of straps 132, allows the desired tightness and fit to be achieved.

Once chaps 100 are fastened in place, the lower portions and hem edges 136, 138 of the thigh portions below straps 132, although unsecured along their length between the lower free hems 138 and the straps 132 adjacent the crotch cutout 135, tend to stay in place on the wearer's legs during normal work movement, and tend not to blow around in normal wind conditions, due to the shape-holding or "memory" effect that the particular preferred medical fabric material exhibits with respect to the curved front contours of a wearer's thighs and the underlying pant fabric, even in a very lightweight single-layer or single-sheet construction with normal (i.e., lightweight) fabric weights for the material.

The outer wiping faces 140 of the chaps 100 can then be used to wipe paint, caulk, oil, dirt, etc. represented schematically at 200 (FIG. 4) from the hands until the wiping face 140 is too dirty for effective wiping. After that the chaps 100 can be removed and thrown away.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this provisional application or in any non-provisional application claiming priority to this provisional application.

The invention claimed is:

1. Disposable pants-protecting chaps comprising:

an upper waist portion configured to extend circumferentially at least part way around a worker's waist;

two spaced protective hands wiping thigh portions attached to and depending from the waist portion and configured to wrap at least partially around the worker's thighs to cover at least front portions of the thighs;

said hands wiping thigh portions comprising a sheet of non-absorbent non-woven composite barrier fabric material comprising a non-absorbent outer hands wiping face and an inner face configured to conform and hold its shape relative to a worker's thigh;

a single thigh fastening strap attached at an attachment point along an inside edge of each said hands wiping thigh portion at a mid-thigh location adjacent a lower end of a contoured crotch cutout and configured to extend around the back of the worker's leg and fasten to an outer edge of an outer face of a portion of the worker's thigh at a corresponding mid-thigh fastening point to secure said hands wiping thigh portion across a front of the worker's thigh; wherein, each said hands wiping thigh portion comprises a lower unsecured portion below the mid-thigh location including a lower free unsecured edge spaced farther from the respective thigh-fastening strap than the thigh-fastening strap is spaced from the lower end of the contoured crotch cutout.

2. The disposable pants-protecting chaps of claim 1, wherein said sheet of non-absorbent non-woven composite comprises medical barrier fabric material.

3. The disposable pants-protecting chaps of claim 2, wherein said fabric material is fluid-resistant and configured to attract and remove painter's fluids such as paint and caulk from the hands and holds them on said fabric material.

4. The disposable pants-protecting chaps of claim 3 in which each of said hands wiping thigh portions is a single layer sheet of lightweight and breathable material.

5. The disposable pants-protecting chaps of claim 4 in which said non-woven composite fabric has a microporous coating.

6. The disposable pants-protecting chaps of claim 5 in which the material used for at least the hands-wiping outer faces of said thigh portions is a fabric material with a 72 gm weight and a thickness of about 11 mil.

7. The disposable pants-protecting chaps of claim 2, wherein the thigh-fastening straps are configured to be removably fastened to strap fastening points along said outer edge of said outer face of said thigh portion.

8. The disposable pants-protecting chaps of claim 7, wherein said fabric material is fluid-resistant as well as non-absorbent and configured to attract and remove painter's fluids such as paint and caulk from the hands and holds them on said fabric material.

9. The disposable pants-protecting chaps of claim 8 in which each of said hands wiping thigh portions is a single layer sheet of lightweight and breathable material which holds its shape with a "memory" effect relative to the worker's thigh that helps conform the thigh portions of the chaps to the worker's pants while working, including the unsecured lower portions of the chaps below the thigh-fastening straps.

10. The disposable pants-protecting chaps of claim 9 in which the material used for at least the hands-wiping outer faces of said thigh portions is a non-woven composite fabric material with a microporous coating.

11. The disposable pants-protecting chaps of claim 10 in which said material of hands wiping outer faces of said thigh portions is a fabric material with a 72 gm weight and a thickness of about 11 mil.

* * * * *